United States Patent [19]

Butler

[11] Patent Number: 5,045,182

[45] Date of Patent: Sep. 3, 1991

[54] APPARATUS AND METHOD FOR REMOVING DEBRIS FROM GRANULAR MATERIAL

[76] Inventor: Kenneth W. Butler, 111 Pacific Ave., Elm Creek, Nebr. 68836

[21] Appl. No.: 439,557

[22] Filed: Nov. 21, 1989

[51] Int. Cl.[5] ..... B07B 1/34; B07B 1/54

[52] U.S. Cl. ..... 209/240; 209/267; 209/314; 209/316; 209/347; 209/382

[58] Field of Search ..... 209/234, 235, 240, 241, 209/255, 257, 267, 310-311, 313-317, 319, 346, 347, 352-357, 381, 382

[56] References Cited

U.S. PATENT DOCUMENTS

| | | | |
|---|---|---|---|
| 18,867 | 12/1857 | Shipley | 209/382 X |
| 115,707 | 6/1871 | Cockrill | 209/356 X |
| 116,549 | 7/1871 | Brunner | 209/319 |
| 440,883 | 11/1890 | Noble | 209/347 |
| 456,448 | 7/1891 | Thomas . | |
| 923,108 | 5/1909 | Bell et al. | 209/347 |
| 994,580 | 6/1911 | Erickson | 209/234 X |
| 1,049,052 | 12/1912 | Clark | 209/315 X |
| 1,064,344 | 6/1913 | Kibler | 209/383 |
| 1,129,875 | 3/1915 | Krebs | 209/235 X |
| 1,229,809 | 6/1917 | Sturtevant et al. | 209/347 |
| 1,229,817 | 6/1917 | Sturtevant | 209/347 |
| 1,229,818 | 6/1917 | Sturtevant | 209/347 |
| 1,229,819 | 6/1917 | Sturtevant | 209/347 |
| 1,229,820 | 6/1917 | Sturtevant | 209/347 |
| 1,229,821 | 6/1917 | Sturtevant | 209/347 |
| 1,247,427 | 11/1917 | Liggett | 209/347 |
| 1,434,691 | 11/1922 | Fraser | 209/314 |
| 1,457,810 | 6/1923 | Alwart | 209/347 |
| 1,568,792 | 1/1926 | Akins et al. | 209/347 |
| 2,329,773 | 9/1943 | Leahy | 209/347 X |
| 2,967,616 | 1/1961 | Philippbar | 209/32 |
| 3,021,952 | 2/1962 | Powell | 209/240 X |
| 3,341,012 | 9/1967 | Thacher | 209/315 |
| 3,468,418 | 9/1969 | Renner | 209/315 |
| 3,752,315 | 8/1973 | Hubach | 209/267 X |
| 4,226,709 | 10/1980 | Popper | 209/315 |
| 4,411,778 | 10/1983 | Venable | 209/314 X |
| 4,861,463 | 8/1989 | Slesarenko | 209/315 |

FOREIGN PATENT DOCUMENTS

| | | | |
|---|---|---|---|
| 3132140 | 3/1983 | Fed. Rep. of Germany | 209/314 |
| 3317811 | 11/1984 | Fed. Rep. of Germany | 209/234 |
| 0720739 | 12/1931 | France | 209/347 |
| 0000683 | of 1893 | United Kingdom | 209/347 |

*Primary Examiner*—Michael S. Huppert
*Assistant Examiner*—Edward M. Wacyra
*Attorney, Agent, or Firm*—Bernard L. Kleinke; Jerry R. Potts; William P. Waters

[57] ABSTRACT

Apparatus for removing debris from granular material includes a set of scalper assemblies and striker assemblies, which are disposed between an inlet and an outlet, and which are interconnected by a mechanical system to help urge the flow of the material through the housing to the outlet. The scalper assemblies are disposed on a set of frames covered with removable screens so that the flow of material falling against the scalper screens, cascades down the screens to form a flowing sheet of material, which falls off of the terminal end of the frame. The scalper screens are tiered and portions thereof are raised and dropped to help urge the larger debris within the granular material downwardly across the scalper screen towards its terminal end, while concurrently permitting the smaller granular material disposed thereon to fall through the screen meshings.

27 Claims, 4 Drawing Sheets

APPARATUS AND METHOD FOR REMOVING DEBRIS FROM GRANULAR MATERIAL

TECHNICAL FIELD

The present invention relates to the general field of separators and methods for removing undesirable material from granular material More particularly, the present invention relates to an apparatus and an improved method of removing debris from desirable granular material, such as removing fines and overs from grain.

BACKGROUND ART

There have been many different types of separators and methods for removing or cleaning undesirable debris from a desired granular material. For example, reference may be made to the following U.S. Pat. Nos. 456,448; 2,967,616; 3,341,012; 3,468,418; and 4,226,709.

While such prior known devices may have been successful for some applications, it has been difficult, if not impossible, to separate or remove undesirable debris, such as fines and overs from grain, in a highly efficient and effective manner, without using very expensive and extremely complex equipment. In this regard, for example, in U.S. Pat. No. 2,967,616, there is shown a separator having a vibrating scalping screen for permitting large foreign material in the grain (sticks, stones, etc.) to be removed. The grain drops through the scalping screen onto a second vibrating screen which removes large foreign grain (corn from wheat, etc.) As the grain passes over the second vibratory screen, it drops onto a third vibrating screen where the fines are removed through this screen. The clean graded and separated grain is then carried over the third screen into a discharge chute for collection.

While such a system may be satisfactory for cleaning granular material for some applications, it has proven to be less than totally satisfactory, in that it has caused other problems. In this regard, the resulting flow of granular material over the screens due to their vibrating motion can cause the material to sheet if the screens are vibrated too slowly. Alternatively, if the screens are vibrated too rapidly, the granular material runs with the debris. The desired granular material, such as grain, is carried with the unwanted debris and is discharged and lost with the unwanted material, such as overs and fines.

Therefore, it would be highly desirable to have a new and improved method and apparatus of separating heavier debris from the lighter granular material in a more efficient and cost effective manner. Such a method and apparatus should reduce greatly the loss of the desired granular material with the debris.

Separators, and more particularly vibrating screen type separators, have been used in the past for separating unwanted debris from granular material. Such apparatus has generally required large motors with sufficient horsepower to produce the necessary dynamic forces to separate efficiently the heavier undesired materials from the lightweight granular material. In this regard, brute force type drives, such as drives which do not operate at or near the natural frequency of the vibrating system of which the screen forms a part, usually employ rotary vibrating motion in conjunction with a tilted or inclined screen to achieve the necessary directional movement of the material being screened. Such apparatus has been generally noisy, and has required very sturdy or rugged construction materials to prevent frequent failures due to breakage or material fatigue caused by the rotary vibrating motion.

Therefore, it would be highly desirable to have a new and improved method and apparatus for performing the desired separation in a highly efficient and effective manner, without requiring the use of bulky and expensive motors, and without the unwanted expenditure of excessively large amounts of energy.

Another problem associated with the brute force type drives has been their susceptibility to failure, due to the driving rotary motion associated with vibrating the frame of such devices and their associated screens. Moreover, such devices due to their complexity, have been difficult to maintain and have been limited to processing only certain types of granular material without expensive and costly modifications.

Therefore, it would be highly desirable to have a new and improved method and apparatus of separating undesired debris from granular material in a very reliable manner. Such an apparatus should be inexpensive to manufacture and maintain and should be adaptable for use in cleaning a variety of granular materials without expensive and costly modifications.

DISCLOSURE OF INVENTION

Therefore, the principal object of the present invention is to provide a new and improved method and apparatus for removing debris from granular material, such as removing overs and fines from grain.

Another object of the present invention is to provide a new and improved method and apparatus for cleaning granular material that is highly reliable, and relatively inexpensive to manufacture and maintain.

Still another object of the present invention is to provide a new and improved method and apparatus for cleaning granular material, in a highly efficient and effective manner at a relatively low cost of operation.

Another object of the present invention is to provide a new and improved method and apparatus that is easily adaptable for cleaning a variety of types of granular material in a simple, inexpensive and cost effective manner.

Briefly, the above and further objects of the present invention are realized by providing a new and improved separation apparatus and method for removing debris from a granular material by separating the debris from the granular material in a highly efficient and cost effective manner with little or no loss of the desired granular material.

Apparatus for removing debris from granular material includes a set of scalper assemblies and striker assemblies, which are disposed between an inlet and an outlet, and which are interconnected by a mechanical system to help urge the flow of the material through the housing to the outlet. The scalper assemblies are disposed on a set of frames covered with removable screens so that the flow of material falling against the scalper screens, cascades down the screens to form a flowing sheet of material, which falls off of the terminal end of the frame.

The scalper screens are tiered and portions thereof are slightly raised and lowered to help urge the larger debris within the granular material downwardly across the scalper screen towards its terminal end, while concurrently permitting the smaller granular material disposed thereon to fall through the screen meshings.

As the larger material reaches the terminal end of the scalper screen, such material falls under the force of gravity into a consolidation chute which directs the material to a second level scalper so the operation may be repeated a second time. After the second operation, the larger material falls into discharge chute which directs the larger debris, known as overs, out of the housing and into a collection hopper for disposal purposes.

As the smaller material falls through the scalper screen under the force of gravity, the smaller material falls onto a striker frame and screen mounted in a substantially parallel spaced apart manner from the scalper frame and screen. The striker assemblies are disposed on the frames and are also connected to the mechanical system, which vibrates the striker screens at a predetermined rate. The vibrating screens help urge the larger material downwardly across the striker screen towards its terminal end, while concurrently permitting the smaller granular material disposed thereon to fall through the openings in the screen.

As the material reaches the terminal end of the striker screen, the material falls under the force of gravity onto a second level striker frame and screen to reverse the flow of the material and to repeat the above described operation. After the second striker operation, the larger material or cleaned grain falls into a discharge chute which directs the material into a collection hopper for distribution purposes.

As the smaller material falls through the striker screen the smaller material falls under the force of gravity onto a plate which directs the debris, in the form of fines, into a consolidate chute.

BRIEF DESCRIPTION OF DRAWINGS

The above mentioned and other objects and features of this invention and the manner of attaining them will become apparent, and the invention itself will be best understood by reference to the following description of the embodiments of the invention in conjunction with the accompanying drawings, wherein.

BEST MODE FOR CARRYING OUT THE INVENTION

Figure 2:
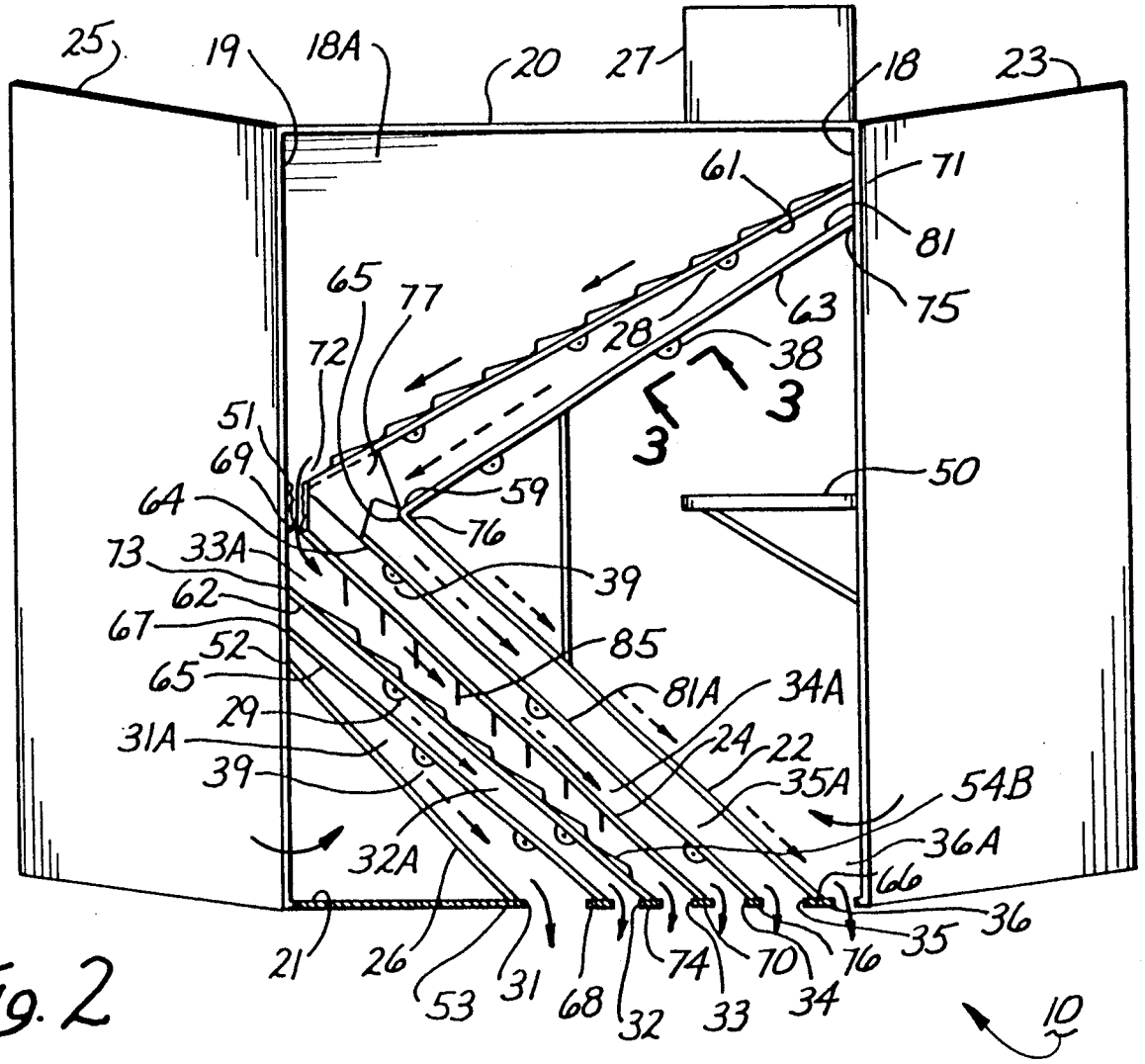
FIG. 2 is a diagrammatic, greatly enlarged side view of the apparatus of FIG. 1, and showing the apparatus with its access doors in an opened position.
Figure 1:
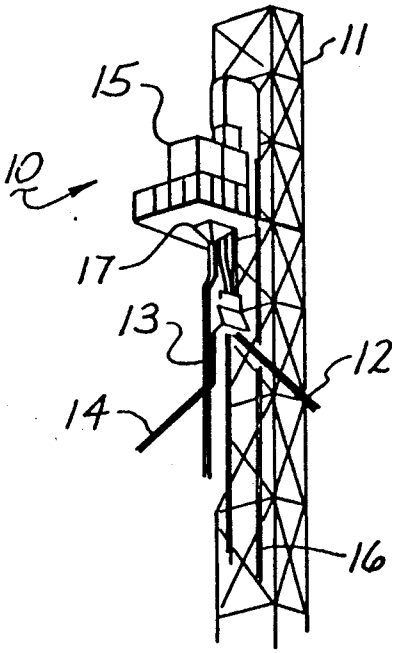
FIG. 1 is a pictorial view of an apparatus for removing debris from granular material, which apparatus is constructed in accordance with the present invention and is shown mounted on a grain cleaning tower.

Referring now to the drawings, and more particularly to FIGS. 1-2 thereof, there is illustrated a grain scalper/screen apparatus 10, which removes debris from granular material, and which is constructed in accordance with the present invention. As shown in FIG. 1, the grain scalper/screen apparatus 10 may be mounted on a tower 11 for allowing the granular material passing through the apparatus 10 to be directed therefrom to various consolidation hoppers (not shown) via a set of discharge chutes shown generally at 12, 13 and 14.

As shown in FIG. 2, the grain scalper/screener apparatus 10 generally comprises a housing unit 15, which includes a set of sidewalls 18 and 19, a top wall 20, and a base or bottom wall 21, which is adapted for connection to the tower 11. The tower 11 joins a set of collection hoppers (not shown) for collecting the cleaned grain and disposing of the debris removed therefrom, such as overs and fines.

The housing unit 15 also includes a back wall 18A, and a pair of access doors 23 and 25 which are shown opened in FIG. 2, and which, when closed, help define the outer peripheral path of travel of the material as it passes downwardly through the housing unit 15. The access doors 23 and 25 also permit access to the interior of the housing unit 15. An inlet 27 is disposed in the upper portion 20 for permitting the granular material to enter therein and an outlet 17 is disposed in the base portion 21 for permitting the exit of the granular material from the housing unit 15. The inlet 27 is connected to a supply chute 16, which carries a supply of granular material, such as grain, to the apparatus 10. The outlet 17 is connected to the discharge chutes 12, 13 and 14 for permitting the separated materials to be discharged to appropriate consolidation hoppers (not shown).

As best seen in FIG. 2, a set of consolidation chutes 31-36 are disposed adjacent to the base portion 21 of the housing unit 15 for collecting and directing the separated materials to their respective discharge chutes 12, 13 and 14. The connection of the consolidation chutes 31-36 to the respective discharge chutes 12-14, is conventional and well known and will not be described hereinafter in greater detail.

The various consolidation chutes 31-36 are extensions of a set of channels 31A-36A respectively formed by a set of plate members 22, 24 and 26 and a set of scalper/striker frame members 61-65 disposed within the interior of the housing unit 15.

The grain scalper/screener apparatus 10 also includes a set of scalper assemblies such as scalper assemblies 28 and 29 which are disposed on scalper frames 61 and 62 respectively. The apparatus 10 further includes a pair of striker assemblies, such as striker assemblies 38 and 39, which are disposed on striker frames 63 and 64 respectively. The scalper assemblies, such as scalper assemblies 28 and 29, and the striker assemblies such as striker assemblies 38 and 39, are interconnected by a motor-driven gear mechanism 30 (FIG. 3) which activates each scalper and striker assembly in a predetermined sequence and at a predetermined rate to help facilitate the travel of the granular material as it passes through the housing unit 15 under the force of gravity.

In operation, as shown in FIGS. 1 and 2, an operator using apparatus 10, commences operation by activating a motor (not shown). The motor, acting through the motor-driven gear mechanism 30, causes the scalper assemblies, such as scalper assemblies 28 and 29 and the striker assemblies, such as striker assemblies 38 and 39 to be activated as will be described hereinafter in greater detail.

When the scalper assemblies, such as scalper assembly 28, have been activated, a flow of granular material is directed by the operator into upper inlet 27. As this material flows therein, the material falls under the force of gravity through inlet 27 and drops against a scalper screen 54 that is removably mounted on the scalper frame 61. Scalper frame 61 includes a set of rail members, such as member 61A and a series of cross bar members such as 71B which hold the rail members in a fixed spaced apart parallel relation. The scalper frame 61 is mounted in the housing unit 15 on an inclined angle with one of its terminal ends 71 being disposed nearer to the inlet 27 than its opposite terminal end 72. The scalper screen 54 is composed of a heavy mesh screen and includes a terminal end (not shown) that is bent downwardly at a ninety degree angle to permit the scalper screen 54 to engage a cross bar member (not shown). In this manner the screen 54 may be mounted on top of frame 61 in a substantially stationary manner. It should be understood that screen 54 is not fixed to frame 61 but rather is loosely attached to the frame 61 so that it may be easily removed from the housing 15. The screen 54 is also loosely attached to the frame 61 so that it may be freely raised and lowered without substantially vibrating the frame 61 as will be described hereinafter in greater detail.

As the flow of material falls against the scalper screen 54 it cascades down its sloping surface and forms a flowing sheet of granular material, which falls off of the terminal end 72 of the scalper screen 54.

In order to facilitate the removal of the unwanted or undesired debris from the granular material, the scalper screen 54 is arranged in a stair-step or tiered fashion. In this regard, screen 54 includes a set of steps, such as step 47*a*, 47*b*, 47*c*, 47*d* and 47*e*, which helps separate or break up the material so it may fall through the screen 54 as it travels towards the terminal end 72 of the scalper frame 61. The successive dropping of the material as it travels along the screen also helps to dislodge the desirable granular material from the unwanted or undesired debris and further prevents the granular material from sheeting so that it may easily fall through the screen mesh openings of screen 54. In order to help facilitate the passing of the granular material through the mesh openings of the scalper screen 54, the scalper screen 54 is also coupled to a set of scalper assemblies, such as scalper assembly 28 and then released from its raised position. In this regard, the scalper assemblies, such as scalper assembly 28 under the control of the motor-driven mechanism 30, strikes or impacts the screen 54 while screen 54 is falling under the force of gravity after having been raised by the scalper assembly 28 and then released from its raised position. The striking force of the scalper assembly 28 thus vibrates the screen 54 to help facilitate the separating of the unwanted or undesired debris from the granular material and helps dislodge granular material that may become lodged in the mesh openings of the screen 54. The raising and dropping of screen 54 also helps to dislodge the desirable granular material from the overs so that it may pass easily through the openings of the scalper screen 54. Finally the raising of the screen 54 also helps facilitate moving the granular material along screen 54.

Scalper screen 54 is disposed removably on scalper frame 61 and is dimensioned to permit only that material having a dimension smaller than the screen mesh openings, to pass therethrough. In this regard, only grain and fines pass through the scalper screen 54, while the larger debris, such as stick, stones, and other foreign materials known, as overs, are urged downwardly along the screen 54. For the purpose of thoroughly removing all the overs from the material, the scalper screen apparatus 10 may include a second level scalping operation. It should be noted however that a single level scalping operation is sufficient to remove substantially all of the overs from the granular material. In this regard, when the debris falls off the terminal edge 72 of screen 54, the debris falls under the force of gravity downward through a channel member 51 and into channel 33A. As the matter passes through the opening in channel member 51 it falls against the second scalper frame 62 and a second tiered scalper screen 54B. The purpose of the second scalper frame 62, its associated screen 54B and scalping assemblies, such as scalping assembly 29, is to provide a second scalping operation. The channel member 51 also prevents the falling material from entering into channel 34A. The second operation is substantially similar to the first operation, except that the flow of the material traveling down the second scalper screen 54B is periodically inhibited as will be explained hereinafter in greater detail.

Considering now scalper frame 62 in greater detail with reference to FIG. 2, the scalper frame 62 is substantially similar to scalper frame 61. In this regard, frame 62 is mounted by one of its ends 73 to side wall 19 adjacent the terminal edge 72 of screen 54 and its opposite end 74 being disposed adjacent outlet 17. With this arrangement, the flow of material along screen 54B is reversed from its flow along screen 54, as it cascades down the sloping surface of screen 54B. When the material reaches the terminal end of screen 54B, it is discharged through outlet 17 and into the consolidation chute 33.

Considering again inlet 27 with reference to FIG. 2, as the granular material falls through inlet 27, it falls against scalper screen 54. As the material travels downwardly along screen 54 it travels toward the terminal end 72 of screen 54, in a path whose outer peripheral edges are defined by the back wall 18A and access doors 23 and 25 of the housing unit 15. As the grain and fines travel along the screen 54 they fall under the force of gravity through the meshing of screen 54 and against a striker screen 81 that is removably mounted on the striker frame 63.

Striker frame 63 includes a set of rail members 63A and 63B and a series of cross bar members such as 55A and 55B which hold the rails 63A and 63B in a fixed spaced apart parallel relation. The striker frame 63 is also mounted in the housing unit 15 on an inclined angle with one of its terminal ends 75 being disposed nearer to the inlet 27 than its opposite terminal end 76. The striker screen 81 is composed on a heavy mesh screen that has mesh openings substantially smaller than the mesh openings of the scalper screens 54 and 54B and includes a terminal end (not shown) which is bent downwardly in a manner similar to screen 54 so that it may engage and be held to frame 63. In this regard, it should be understood that screen 81 is also loosely attached to the frame 63 so that it freely vibrates as will be explained hereinafter in greater detail.

As the flow of material falls against the striker screen 81, it cascades down screen 81 and forms a flowing sheet of granular material, which falls off the terminal end 59 of the striker screen 81.

The striker screen 81, like the scalper screen 54 is removable and defines the pathway along which the granular material is directed. In this regard the back wall 18A and access doors 23 and 25 of the housing unit 15 define the outer periphery of the pathway of travel along screen 81.

Screen 81 has a mesh dimensioned to prevent fines within the material from entering the grain channel 35A. In this regard, as the fines in the granular material cascades downwardly along screen 81, they pass therethrough and fall downwardly under the force of gravity against plate member 22.

As the material cascades down screen 81, a set of strikers assemblies, such as striker assembly 38, cause the striker screen 81 to vibrate at a predetermined rate. This vibration helps facilitate the granular material's flow as it travels downwardly along its path of travel and off the terminal end 59 of the striker screen 81.

As the material falls through screen 81, it falls against plate member 22 which is connected at one of its ends 65 to terminal end 59 of the striker frame 63 to form an apex with frame 63. The opposite end 66 of the plate member 22 is connected to the base 21 adjacent outlet 17. As the fines fall against plate 22, their direction of flow is reversed as they continue downwardly across plate 22 and toward outlet 17 into consolidation chute 36.

When the flow of granular material falls off the terminal end 59 of the striker screen 81, it falls under the force of gravity downwardly against a second striker frame 64 and its associated screen 81A that are substantially similar to striker frame 63 and screen 81. Striker frame 64 and its associated screen 81A are spaced apart from plate member 22. The striker frame 64 is mounted to a support frame 77 which also supports striker frame 63, scalper frame 61 as well as plate member 22. Support frame 77 is connected to the channel member 51 that is connected to side wall 19. In this regard, the channel member 51 also supports plate member 24. Channel member 51 and support frame 77 are so arranged to hold frames 61 and 63 in a spaced apart manner as well as plate 22, frame 64 and plate 24.

As best seen in FIG. 2, the support frame 77 defines a wall that prevents the flow of material cascading off the terminal end or edge 59 of striker screen 81 from entering channel 34A connected to chute 34. Thus, as the granular material falls off the terminal end 59 of striker screen 81 its direction of flow is also reversed, as it travels downwardly along its associate screen toward outlet 17 and into consolidation chute 34.

Striker screen 81A associated with frame 64 is dimensioned to substantially prevent the flow of the cleaned granular material from entering chute 34. In this regard, as the granular material cascade downwardly across striker screen 81A, the fines in the material pass through screen 81A and fall under the force of gravity against the spaced apart plate member 24 which directs the fines to consolidation chute 34 and to outlet 17.

As the granular material cascades down the striker screen 81A, a set of strikers assemblies, similar to striker assembly 38, causes the striker screen to vibrate at a predetermined rate which helps facilitate the downward path of travel of the granular material into consolidation chute 34.

Plate member 24 is connected at one of its terminal ends 69 to channel member 51. The opposite end 70 of the plate member 26 is connected to base 21 adjacent outlet 17. In this regard, as the fines fall through screen 81A and against plate member 24 they continue to flow in their same generally downward direction along plate 24 toward outlet 17 and into consolidation chute 34.

Considering again the flow of material through assembly 10 with reference to FIG. 2, when the granular material falls off the terminal end 72 of scalper screen 54, channel member 51 prevents the material falling off the terminal end of screen 54 from entering chute 34 and directs the material into chute 33. The material falling into chute 33 will have a concentration of overs therein as a substantial amount of the granular material less the overs will have already passed through scalper screen 54. In this regard, as the material falls into the channel forming part of chute 33, the granular material will consist primarily of overs which will rapidly travel along screen 54B because of the larger mass of debris therein.

To reduce this rate of flow, a set of flow retarders, such as flow retarder 85, are disposed in the channel forming part of chute 33. The flow retarders operate in conjunction with the tiered scalper screen 54B to effectively and intermittently block various portions of the channel forming part of chute 33. This blocking action, periodically stops the downward flow of the material as it travels down chute 33. In this manner, the granular material and fines that remain in the flowing material following the first scalping operation will travel along scalper screen 54B and will fall through its meshing under the force of gravity against a striker screen 81B associated with the striker frame 65.

Striker screen 81B and striker frame 65 are spaced apart from scalper frame 62 and are substantially similar to striker screen 81A and striker frame 63. Striker frame 65 is mounted on an inclined angle between side wall 19 and base member 21. The removable striker screen 81B is similar to striker screens 81 and 81A, and is loosely mounted to frame 65 so that the screen 81B may freely vibrate without substantially vibrating frame 65. Thus, when the granular material falls through scalper screen 54B associated with scalper frame 62 it falls against the striker screen 81B thus, permitting the material to continue to flow in its same generally downward direction along the surface of screen 81B toward outlet 17 and into consolidation 32.

As the granular material cascades down the striker screen 81B associated with striker frame 65, a set of strikers assemblies, similar to striker assembly 38, causes the striker screen 81B to vibrate at a predetermined rate for helping to facilitate the movement of the cleaned granular material into consolidation chute 32. The vibrating motion of the screen 81B also helps facilitate passage of any remaining fines in the material through the striker screen 81B and into chute 31.

As the remaining fines, if any, fall through the striker screen 81B they fall under the force of gravity against the plate member 26. Plate member 26 is spaced apart from the striker screen 81B and has one of its terminal ends 52 mounted to sidewall 19. The opposite end 53 of plate 26 is mounted to base 21 adjacent outlet 17. As the fines fall against the plate member 26 they continue to flow in their same general direction across the plate's surface toward outlet 17 and into consolidation chute 31.

With this unique arrangement of the tiered movable scalper screens, vibrating striker screens and the stationary plate members being disposed within housing unit 15, a series of pathways are defined that include separated paths of travel for the overs, fines, and cleaned granular material as the flow of material progresses downwardly through and out of the housing unit 15. Thus, the flow of the material is controlled to effectively and efficiently remove the unwanted and undesired overs from the granular material while concurrently removing the more difficult to remove fines.

Considering now the housing unit 15 in greater detail with reference to FIG. 2, the housing unit 15 is generally an enclosed structure whose interior may be accessed through access doors 23 and 25. The housing unit 15 is constructed from sheet metal and has a sturdy construction to support a motor (not shown) and its associated gear mechanism 30, as well as the various frames, screens, striker assemblies and scalper assemblies. The housing unit 15 also includes an access platform 50 that permits an operator of the apparatus 10 to reach the removable scalper and striker screens associated with frames 61 and 63.

Considering now striker assemblies 38 and 39 with reference to FIG. 2, the striker assemblies 38 and 39 are substantially similar to one another and only striker assembly 38 will now be described in greater detail.

Figure 3:
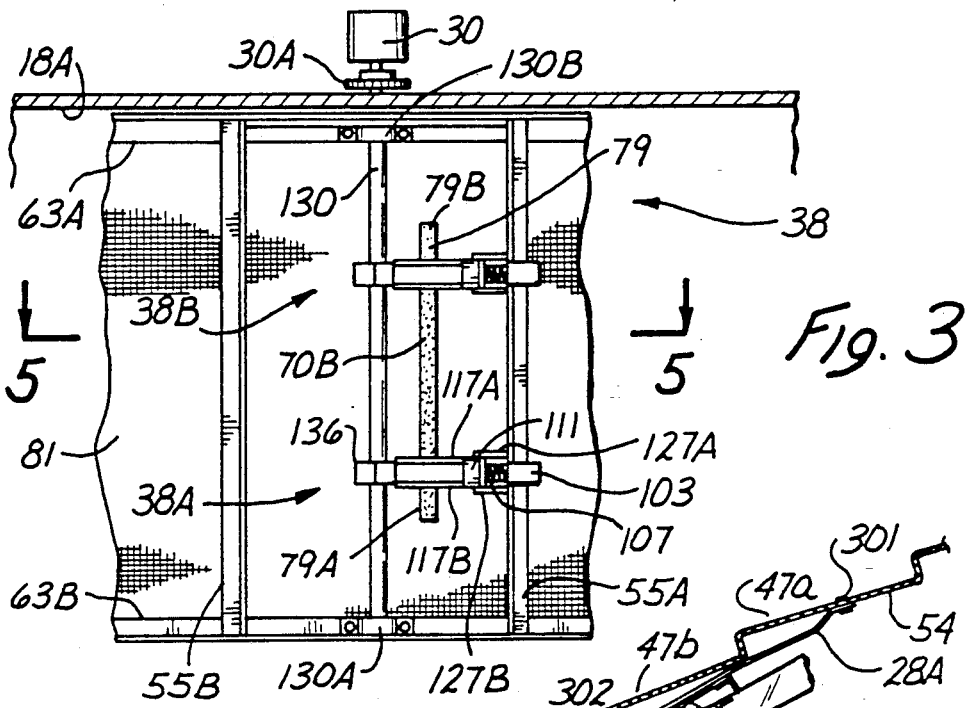
FIG. 3 is an enlarged fragmentary, underside face view of the apparatus of FIG. 2, taken substantially on line 3—3 of FIG. 2.

As best seen in FIG. 3, the striker assembly 38 is mounted to between cross bar members 55A and 55B forming part of striker frame 63. The assembly 38 includes a pair of striker members 38A and 38B which are substantially similar to one another and only striker member 38A will be described hereinafter in greater detail. The striker members 38A and 38B are affixed to cross bar member 55A by a suitable means such as a weld joint, to provide a strong stationary base support that will enable the striker screen 81 to be effectively vibrated as will be described hereinafter in greater detail.

Figure 5:
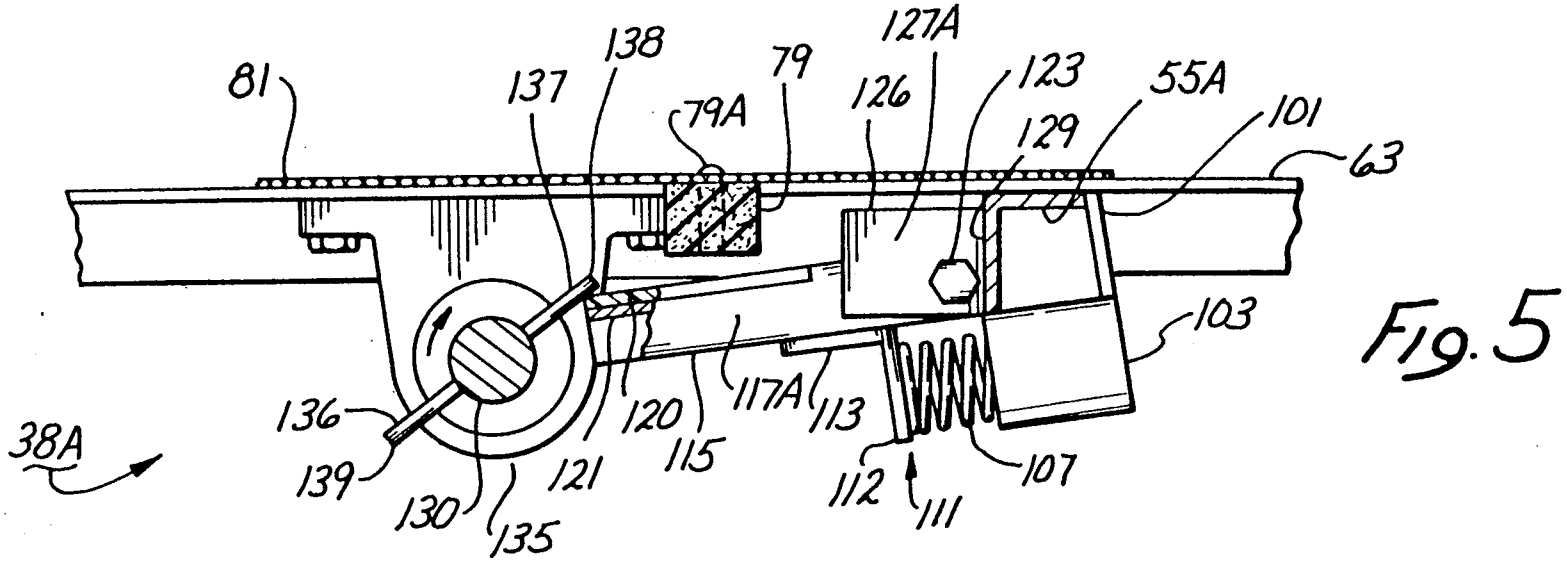
FIG. 5 is a sectional view of the striker assembly of FIG. 3, taken substantially on line 5—5 of FIG. 3, showing the striker assembly in a tensioned position.
Figure 6:
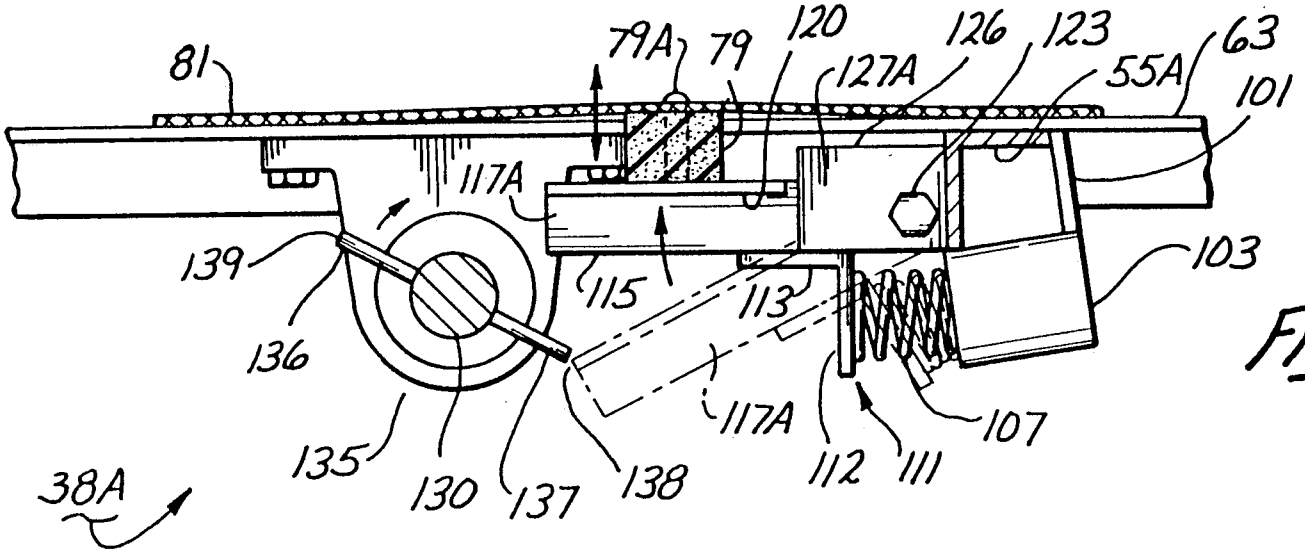
FIG. 6 is a sectional view of the striker assembly of FIG. 3, similar to FIG. 5, except showing the striker assembly in its released position.

Considering now striker member 38A in greater detail with reference to FIGS. 3, 5 and 6, striker member 38A generally comprises a flat base plate 101 which is securely fixed to cross bar member 55A by any suitable means, such as welding the base plate 101 to the cross bar 55A. The base plate 101 projects downwardly from cross bar member 55A at a very nearly perpendicular angle and terminates in a hollow square-shaped boss 103 that is integrally connected to plate 101.

Boss 103 is composed of a rigid metallic composition such as channel iron and is dimensioned for receiving a heavy duty compression spring 107. In this regard, an end portion of spring 107 is confined securely within the hollow square-shaped boss 103 to properly position the spring 107 relative to cross bar member 55A.

The opposite end of the spring 107 is affixed to a retaining clip (not shown) that permits the spring 107 to be attached to an L-shaped push plate 111. Plate 111 is composed of a rigid metallic composition such as channel iron. The width of push plate 111 approximates the width of boss 103 and permits spring 107 to be securely positioned between the plate 111 and the hollow confines of boss 103. In this regard, spring 107 may be compressed within the hollow confines of boss 103 when plate 111 is moved toward boss 103 as will be described hereinafter in greater detail.

Considering now plate 111 in greater detail with reference to FIGS. 5 and 6, plate 111 includes two leg portions 112 and 113. Leg portion 112 includes an opening or hole (not shown) that is dimensioned to receive a bolt (not shown) for removably affixing the spring 107 to leg 112.

Leg 113 is perpendicular to leg 112 and is attached to a striker plate 115. Striker plate 115 is pivotally mounted relative to cross bar member 55A so that it may move push plate 111 inwardly toward boss 103 to compress spring 107.

Striker plate 115 is generally channel-shaped, and has a unitary structure and is composed of a rigid metallic composition. The striker plate 115 includes a pair of elongated side plate portions 117A and 117B and an interconnecting flat elongated bight portion 121. The surface of bight portion 121 is covered with a soft resilient material 120, such as polyurethane or rubber.

The striker plate 115 is pivotally mounted to a pivot rod 123. The pivot rod 123 is removably affixed to a base section 126 that is also affixed to cross bar 55A. Base section 126 is channel shaped and includes a pair of spaced apart side plate portions, 127A and 127B and an integrally interconnecting bight portion 129. Bight portion 129 is welded to the cross bar member 55A so that the side plate portions 127A and 127B of the base section 126 extend perpendicularly away from the cross bar member 55A.

Each side plate portion, such as side plate portion 127A includes a centrally disposed hole (not shown) adjacent the bight portion 129 that is dimensioned to receive the pivot rod 123. The holes in the side plates are parallel to one another so that when pivot rod 123 is passed therethrough the pivot rod 123 will rest in a parallel spaced apart plane to cross bar member 55A.

The side plate portion 127A and 127B of the base section 126 are parallel and spaced apart to one another at a distance slightly greater than the distance between the side plate portions 117A and 117B of the striker plate 115.

Each side plate portion, such as side plate portion 117A includes a centrally disposed hole (not shown) adjacent one of its terminal edges which is dimensioned to receive a pivot rod 123. The holes in the side plate portions 117A and 117B are parallel to one another so that when the pivot rod 123 is passed through the respective holes of the side plate positions 117A, 117B, 127A, 127B, the striker plate 115 can freely rotate about the pivot rod 123.

With this arrangement striker plate 115 is received between the side plate portions 127A and 127B in the base section 126 in such a manner that the holes in each respective plate 127A and 127B align thereby permitting pivot rod 123 to pass therethrough, and through side portions 117A and 117B to enable the striker plate 115 to pivot about the base section 126 relative to cross member 55A.

Considering again the L-shaped push plate 111 with respect to FIG. 5, plate 111 is affixed to plate 117 in a manner that permit the striker plate 115 to freely rotate about pivot rod 123. In this regard, striker plate 115 is biased by spring 107 so that the polyurethane surface 120 on the bight portion 121 is compressed against a channel bar 79. Channel bar 79 is mounted to the striker screen 81 by a set of fastener devices 79A, 79B and 79C. Channel bar 79 is fixed in a parallel spaced apart manner between cross bar members 55A and 55B. The channel bar 79 is composed of a suitable resilient material such as rubber and causes the striker screen 81 to slightly raise and fall when the striker plate 115 strikes the channel bar 79. This striking action thus causes screen 81 to vibrate without substantially vibrating the frame 63.

In order to cause the striker plate 115 to strike the channel on bar 79 a drive shaft 130 is mounted to the striker frame 63. As best seen in FIG. 3, shaft 130 is mounted between a pair of bearing assemblies 130A and 130B that permit the shaft 130 to freely rotate therein when driven by mechanism 30. The drive shaft 130 is mounted in a parallel spaced apart manner from cross bar members 55A and 55B and includes an actuating paddle assembly 135.

Considering now actuating paddle assembly 135 in greater detail with reference to FIGS. 5 and 6, the paddle assembly 135 consists of two plate members 136 and 137 that extend radially outwardly from shaft 130 in diametrically opposing directions. Plate members 136 and 137 are mounted opposite each other and extend outwardly from shaft 130 each terminating in a tip portion such as the tip portions shown generally at 138 and 139 respectively.

When shaft 130 is rotated clockwise about its longitudinal axis by the driving mechanism 30, the tip portions 138 and 139 sequentially come into contact with the polyurethane surface 120 of the striker plate 115. In this regard, a sufficient driving force is imparted by each tip, such that each tip urges the striker 115 away from channel bar 79 in a counterclockwise direction. As the striker plate 115 moves away from the channel bar 79, the push plate 111 of the striker 115 forces spring 107 into greater and greater compression. In this regard, as best seen in FIGS. 5 and 6, when the tip, such as tip 138 is forced against the striker 115 it urges the striker 115 in a counterclockwise direction away from the channel bar 79. As the clockwise rotation of drive shaft 130 continues, the tip portion, such as tip 138, is urged off the outer terminal edge of the bight portion 121. When the tip portion 138 is urged off the terminal edge of the striker plate 115 the striker plate is released and snaps back under the compression force of spring 107 in a clockwise direction against channel bar 79. The upward striking force of the striker plate 115 against the channel bar 79 causes a small portion of striker screen 81 to be slightly raised off of the top of the rail members 63A and 63B. It should be understood that the screen 81 is composed on heavy duty stiff meshed screen so that the weight of the screen 81 coupled with its stiffness is sufficient to maintain the orientation of the screen relative to the frame 63 at all times. In other words, the force generated from the striker assembly is sufficient to slightly raise and lower the screen 81 for vibrating purposes, but not of sufficient force to dislodge the screen 81 from its resting orientation on the rail members 63A and 63B of the frame 63.

In order to impart a sufficient vibrating force to the striker screen 81, two striker members 38A and 38B are mounted between the cross bar members 55A and 55B. Although a greater or lesser number of striker assemblies could be utilized, optimum results are achieved when two assemblies are used and which are activated between the rates of 60 to 20 cycles per minute with an optimum rate of 40 cycles per minute.

Figure 4:
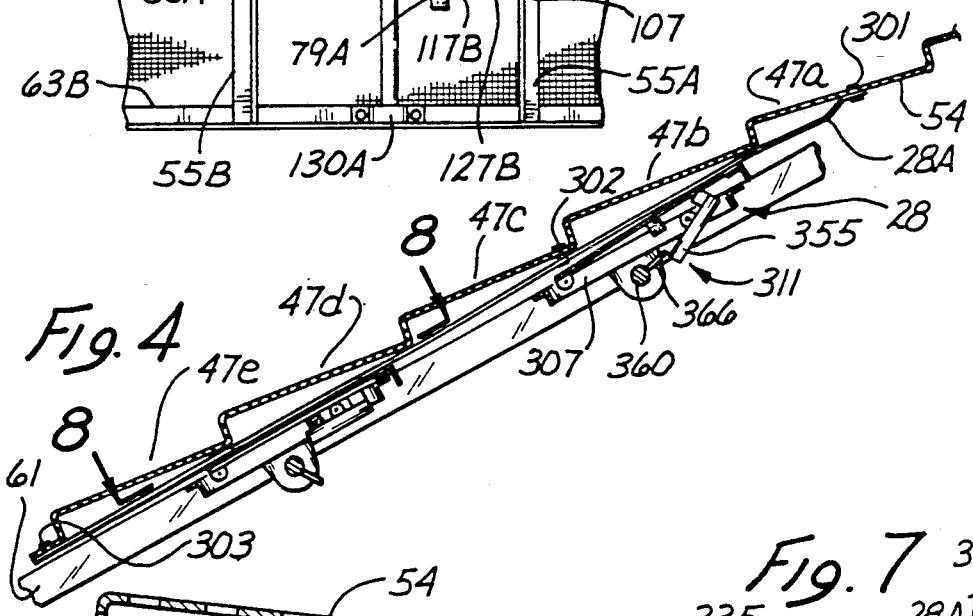
FIG. 4 is a greatly enlarged sectional view of a scalper assembly of the apparatus of FIG. 2.
Figure 8:
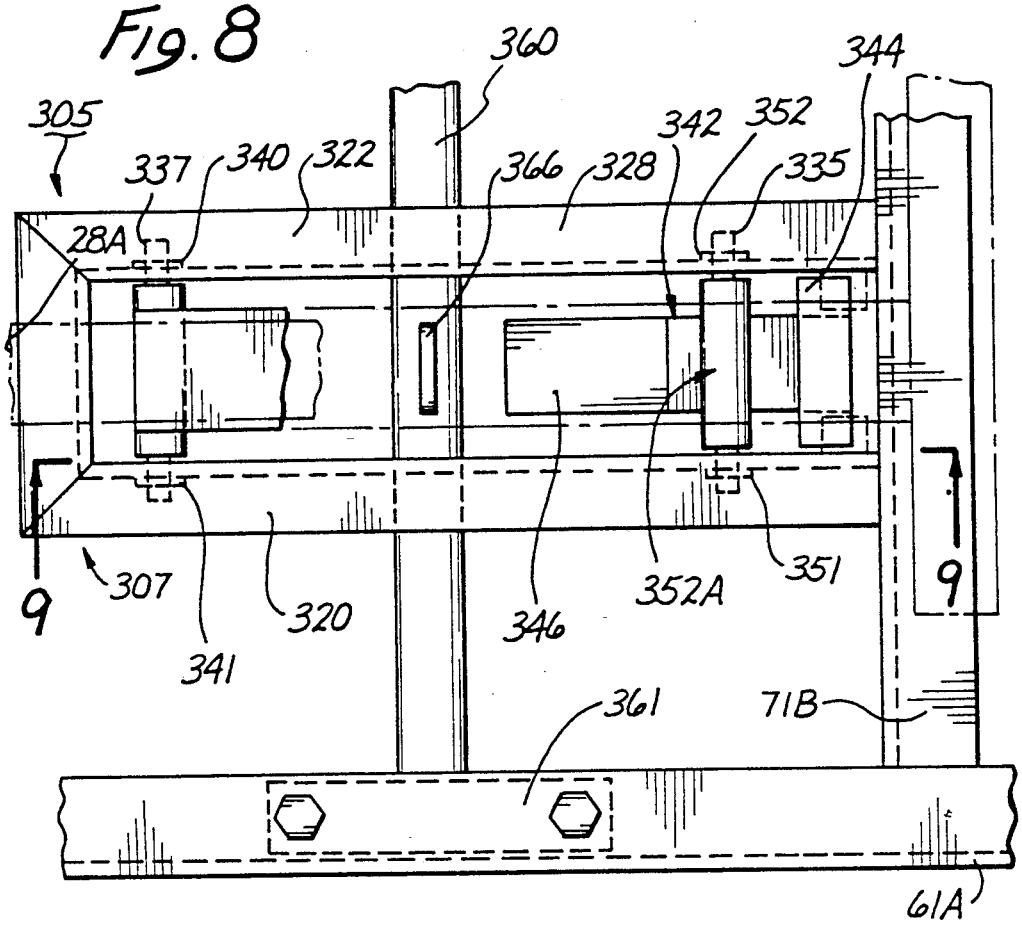
FIG. 8 is a fragmentary view of the scalper assembly of the apparatus of FIG. 4, taken substantially on line 8—8 of FIG. 4.

Considering now scalper screen 54 in greater detail with reference to FIGS. 4 and 8, scalper screen 54 is composed of a heavy mesh wire and is disposed between a pair of side rails, such as side rail 61A of frame 61. Scalper screen 54 is arranged in a stepped or tiered manner for helping to facilitate the moving of the grain and debris materials along the screen surface and for dropping the materials as they move from one step to the next for helping to facilitate the separation of the granular material from the debris contained therein. The scalper screen 54 also includes a pair of strap members, such as strap member 28A for creating a lifting surface to permit the screen 54 to be raised from and dropped onto the frame 61 as will be described hereinafter in greater detail. The strap members, such as strap member 61A, are spaced apart in a parallel manner with each respective strap being disposed adjacent to a side rail, such as side rail 61A as shown in FIG. 8. The straps are secured to the screen 54 by a set of conventional securing devices, such as devices 301, 302, and 303.

The scalper screen 54 is of a unitary construction and is dimensioned to extend between the side rails of frame 61 throughout its entire longitudinal length. The terminal end of screen 54 is bent downwardly at approximately a ninety degree angle to permit the screen to be loosely attached to frame 61 at its terminal end 71. A pair of retaining clips (not shown) securely hold the end portion of screen 54 to the frame 61. The screen 54 is tiered in a series of successive steps where the distance of such vertical descending portion of the screen is substantially less than the corresponding horizontal portion of the screen. In this regard, the ratio between the horizontal portion and the vertical portion is approximately seven-to-one. In the preferred embodiment of the present invention the ratio is five-to-one. The screen meshing of the scalper screens is of a substantially greater meshing than the striker screens. In this regard, the scalper screens 54 and 54B permit both the desired granular material and the fines to pass therethrough while the striker screens 81, 81A and 81B only permit fines to pass therethrough.

Considering now the scalper assemblies 28 and 29 with reference to FIG. 2, the scalper assembles 28 and 29 are substantially similar to one another and only scalper assembly 28 will now be described in greater detail.

Figure 9:
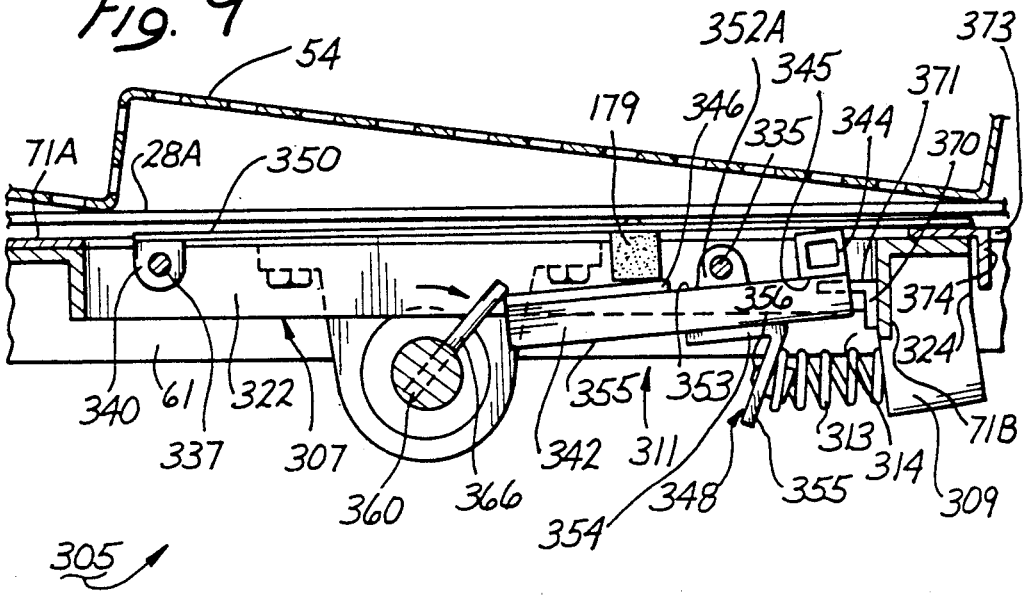
FIG. 9 is a greatly enlarged sectional view of the scalper assembly of FIG. 8, taken substantially on line 9—9 showing the scalper assembly in a lowered position.

As best seen in FIGS. 3, 8 and 9, the scalper assembly 28 generally includes a pair of scalper units, such as scalper unit 305. The scalper units are substantially similar to one another and only scalper unit 305 will be described hereinafter in greater detail. Each respective scalper unit is affixed to a cross bar member, such as cross bar member 71B which extends between the side rail members of frame 61. The scalper units are affixed to their associated cross bar member by a suitable means such as a weld joint, to provide a strong stationary base support enables the scalper screen 54 to be effectively lifted, dropped and vibrated as will be described hereinafter in greater detail.

Considering now the scalper unit 305 in greater detail with reference to FIGS. 4, 7, 8, and 9, the scalper unit 305 generally comprises a housing 307 having a hollow boss portion 309, a pivot block 311 pivotally mounted relative to the housing 307, a compression spring 313, a stop 314, and an actuator 315. The scalper unit 305 acts against one of the strap members, such as strap member 28A to raise the screen 54 as will be described hereinafter in greater detail.

Considering now the housing 307 unit with reference to FIGS. 4, 7, 8 and 9, the housing unit 307 is generally a U-shaped integrally formed hollow frame that includes a pair of side wall portions 320 and 322, and an end wall portion 324. The housing 307 is disposed slightly spaced apart from side rail 61A in a parallel manner and extends substantially perpendicular to cross bar member 71B so that the housing 307 is substantially aligned beneath the strap member 28A. In this regard, the housing 307 is rigidly secured between cross bar members 71A and 71B by any suitable means such as welding.

For the purpose of pivotally mounting the pivot block 311 relative to the housing 307, a pivot pin 335 is fixed at its ends 351 and 352 (FIG. 8) between the side wall portions 320 and 322 respectively and is journalled for rotation about its axis within a pivot sleeve 352A, fixed by suitable means, such as welding to the upper surface 353 of the block 311. Another pivot pin 337 is disposed between the other journals and is adapted to permit a lever arm 350 to pivot thereabout as will be explained hereinafter in greater detail.

The end wall portion 324 of the housing 307 projects downwardly relative to cross bar member 71B at a very nearly perpendicular angle and terminates in the hollow square-shaped boss portion 309 that is an integral part of the housing 307. Boss 309 is comprised of a rigid metallic composition such as channel iron and is dimensioned for receiving the heavy duty compression spring 313. In this regard, an end portion of the spring 313 is confined securely within the hollow square-shaped boss 309 to properly position the spring 313 relative to the cross bar member 71B and the pivot block 311 when it is mounted to housing 307.

Considering now the pivot block 311 in greater detail with reference to FIGS. 4, 7, 8 and 9, the pivot block 311 generally comprises a metallic frame member 342, an engaging member 344 and striking member 346 secured to the frame member 342 and an integrally connected substantially V-shaped push plate member 348. The pivot block 311 pivots about pivot pin 335 in a counter clockwise direction relative to the housing 307 to raise the screen 54 in a clockwise direction about pin 335 as will be explained hereinafter in greater detail.

Figure 7:
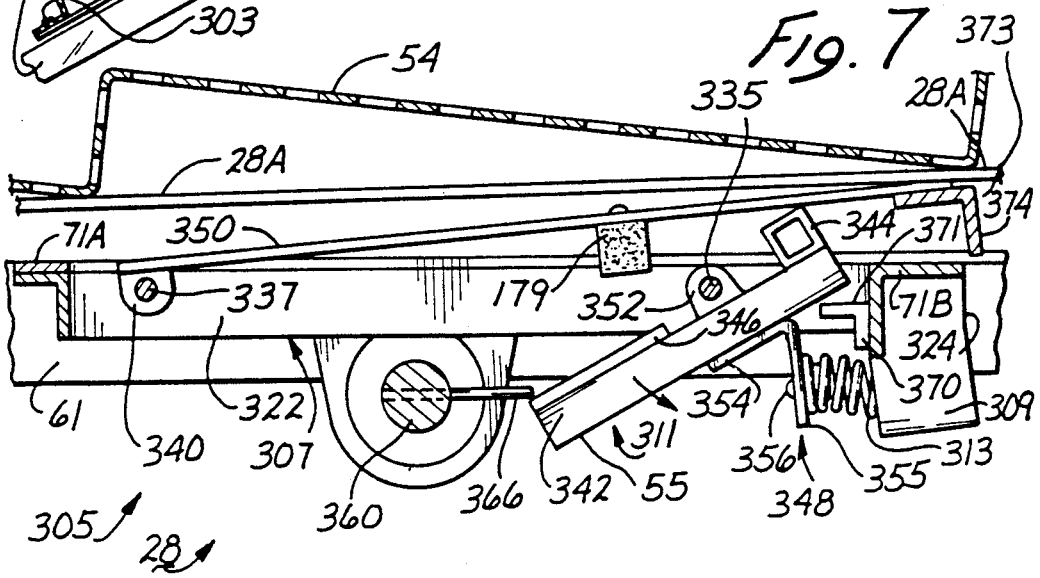
FIG. 7 is a greatly enlarged sectional view of the scalper assembly of FIG. 4 showing the scalper assembly in a raised position.

Considering now the frame member 342 in greater detail with reference to FIGS. 7, 8 and 9, frame member 342 is a rectangularly shaped metallic plate that includes two leg portions 351 and 352. Leg portions 351 and 352 extend perpendicularly upwardly from the top surface 353 of the frame member 342 and are disposed in a parallel spaced apart manner adjacent to the respective side edge portions of the frame 342. Each leg portion 351 and 352 include an opening or hole that is dimensioned to receive the pivot pin 335 therethrough. The holes in the legs 351 and 352 are parallel to one another so that when pivot pin 335 is passed therethrough, the pivot pin 335 is disposed in a parallel spaced apart plane to cross bar member 71B.

Consider now the engaging member 344 in greater detail, the engaging member 344 is generally an elongated hollow bar composed of a resilient material such as hard rubber. The engaging member 344 is adapted to engage one end of the lever arm 350 for lifting screen 54. Engaging member 344 is securely mounted to the top surface 353 of the frame member 342 by any suitable means, such as by an adhesive or any other equivalent manner. The engaging member 344 has a width that approximates the width of the lever arm 350.

Considering now the striking member 346 in greater detail, the striking member 346 is generally a flat plate of polyurethane material which is attached to the top surface 353 of the frame member 342 by any suitable means, such as by an adhesive or any other equivalent manner. The striking member 346 is disposed at the opposite end of the top surface 353 away from the engaging member 344 and is adapted to engage a channel bar 179 when the pivot block 311 is biased by the spring 313 as will be explained hereinafter in greater detail.

Considering now the push plate member 348 in greater detail, the push plate number 348 is rigid, and is integrally connected to the frame member 342. The plate member 348 is generally V-shaped, and includes an upper leg portion 354 which is integrally connected to the bottom surface 355 of frame member 342 opposite the pivot pin 335. Upper leg portion 354 is centrally disposed on surface 355 directly below leg portions 351 and 352.

The plate member 348 also includes a lower leg portion 355 which depends downwardly from the upper leg portion 354 at a slightly inclined angle from the perpendicular. The lower leg portion 355 includes a centrally disposed opening or hole (not shown) which is adapted to receive a screw 356 for securing a retaining clip (not shown) attached to spring 313. In this regard, the spring 313 is attached to the lower leg 355 and may be compressed within the hollow confines of boss 309 when the lower leg portion 355 is moved toward boss 309 as will be described hereinafter in greater detail.

In order to cause the pivot block 311 to be moved pivotally relative to housing 307, a drive shaft 360 is mounted to the scalper frame 61. Shaft 360 is mounted between a pair of bearing assemblies, such as bearing assembly 361, that permits the shaft 360 to rotate freely therein when driven by the driving mechanism 30. In this regard, a drive chain 30A is disposed between driving mechanism 30 and the drive shaft 360. The drive shaft 360 is mounted in a parallel spaced apart manner from crossbar 71B and includes an actuating paddle 366 thereon. Paddle 366 extends outwardly from drive shaft 360 and terminates in a tip portion shown generally at 362.

When shaft 360 is rotated clockwise about its longitudinal axis by the driving mechanism 30, the tip portion 362 comes into contact with the polyurethane striking member 346 of the pivot block 311. In this regard, a sufficient driving force is imparted by the tip portion 362 to urge the pivot block 311 downwardly in a counterclockwise direction about pivot pin 335. As the pivot block 311 moves downwardly, the plate member 348 forces spring 313 into progressively greater compression. Simultaneously, the engaging member 344 of the pivot block moves upwardly in a counterclockwise direction (FIG. 7) and against the lever arm 350 to cause lever arm 350 to pivot about pivot pin 337 in a counterclockwise direction (FIG. 7) and into lifting engagement with strap member 28A. As the lever arm 350 engages the strap member 28A, screen 54 is raised off the frame 61 in the immediate area of the applied force exerted by lever arm 350.

As the clockwise rotation of drive shaft 360 continues, the tip portion 362 moves past the edge of the pivot block 311 to release the pivot block 311. When pivot block 311 is released, spring 313 expands causing the pivot block 311 to rotate abruptly in a clockwise direction (FIG. 7), thus permitting the screen 54 to drop backwardly toward the frame 61. However, as the screen 54 drops, and as the pivot block 311 snaps back under the compression force of spring 313, the striking member 346 is forcefully urged abruptly against the underside of the channel bar 179. The resulting upward impact of the striking member 346 on the falling channel bar 179 causes lever arm 350 to again engage the strap member 28A to raise slightly or bounce upwardly and abruptly lift the screen 54 off of frame 61. Immediately thereafter, the screen 54 falls onto the frame 61. Thus, the raising and then falling of the screen, together with the impacting on the underside of the falling screen 54, causes the screen 54 to vibrate helping to separate the unwanted or undesired overs from the grain. In addition, the described action also helps to facilitate dislodging granular material that becomes lodged in openings of the screen 54 thus, enabling the grain to pass easily through the openings of the scalper screen 54 as it travels toward the outlet 17.

It should be understood that the screen 54 is composed of stiff, rigid mesh screen so that the weight of the screen 54 coupled with its stiffness is sufficient to maintain the orientation of the screen 54 relative to the frame 61 at all times. Thus, the force generated from the pivot block 311, when moved in a clockwise direction against the channel bar 179 is sufficient to raise slightly the screen 54 for subsequent vibrating purposes. This force is not sufficient to dislodge the screen 54 from its orientation on the frame 61. It should be understood that because the screen 54 is not affixed to the frame 61, there is little or no vibration associated with the frame 61. Although the preceding description related to the operation of one scalper assembly, it should be understood that a drive shaft, such as drive shaft 360, is associated with each scalper assembly so that the scalper assemblies operate in unison.

Considering now the stop 314 in greater detail with reference to FIGS. 7, 8 and 9, the stop 314 is generally L-shaped and has a unitary structure and rigid metallic composition. The stop 314 includes a pair of elongated leg portions 370 and 371. Leg portion 370 is affixed securely to cross bar member 71B by any suitable means such as welding. In this regard, leg portion 371 extends perpendicular outward from cross bar member 71B at a sufficient distance to substantially engage a lower portion 345 of the engaging member 344. In this regard, when pivot block 311 is forced to rotate in a clockwise direction by the force exerted through spring 313, the lower surface 345 of the engaging member 344 comes into stopping engagement with leg 371 of the stop 314.

Considering now the lever arm 350 in greater detail with reference to FIGS. 7 and 9, the lever arm 350 is an elongated plate having a pair of parallel spaced apart downwardly projecting legs 340 and 341 disposed on one terminal end thereof. Each leg, such as leg 340, includes a centrally disposed hole which is dimensioned to receive the pivot pin 337. The holes in legs 340 and 341 are parallel to one another so that when pivot pin 337 is passed through the respective holes, the lever arm 350 can freely rotate about the pivot pin 337. The opposite end of the lever arm includes an integrally attached L-shaped cross bar portion 373 which includes a downwardly depending leg portion 374. Lever arm 350 has a longitudinal length that is dimensioned to permit its downward depending leg portion to extend slightly beyond cross bar 71B. In this regard, the lever arm 350 is disposed in a resting position on top of housing 307 and is oriented directly below strap 28A so that it may engage strap 28A when the lever arm 350 is moved in a clockwise direction by the pivot block 311.

In order to help facilitate the separation of the overs from the other granular material as the scalper screen is raised and dropped at selected areas in the stair-stepped configuration, the scalper assemblies, such as scalper assemblies 38 and 39 are operated in unison in a manner that is substantially similar to striker assemblies 28 and 29. In this regard, optimum results are achieved when two scalper assemblies are used and activated between the rate of 10 to 30 cycles per minute with an optimum rate of 20 cycles per minute It should be understood however that a greater or lesser member of scalper assemblies could be utilized.

Considering now the flow retarder 85 in greater detail with reference to FIG. 2, each flow retarder is substantially identical so only flow retarder 85 will be described hereinafter in greater detail.

As best seen in FIG. 2, flow retarder 85 is fixed to plate 24. Flow retarder 85 is composed of a resilient material, such as denim, that extends across the entire width of the channel extending to chute 33. The flow retarder 85 hangs from plate 24 in such a manner that its terminal end 85A is positioned above and spaced apart from the scalper screen 54B. In this regard, as the scalper screen 54B is raised the gap between the terminal end 85A of the flow retarder 85 and the screen 54B becomes smaller so that the raised scalper screen in combination with the flow retarder 85 helps to effectively and partially block the channel 33, thus inhibiting the flow of material in the channel, each time the screen is raised.

While particular embodiments of the present invention have been disclosed, it is to be understood that various different modifications are possible and are contemplated within the true spirit and scope of the appended claims. There is no intention, therefore of limitations to the exact abstract or disclosure herein presented.

What is claimed is:

1. A grain cleaning apparatus comprising:

a housing unit for receiving granular material;

scalping means mounted in said housing unit for removing large debris from the granular material by permitting the granular material to fall through said scalping means;

vertical reciprocation means for raising and lowering said scalping means repeatedly to help facilitate the movement of the large debris along said scalping means;

impact means for striking abruptly to apply a jarring impact to said scalping means from below as said scalping means moves downwardly for helping to facilitate the removal of granular material that may be lodged in said scalping means by jarring lodged granular material from said scalping means; and actuating means for responding to said scalping means moving downwardly only; and means responsive to said actuating means responding to said scalping means moving downwardly only for moving said impact means extensively into the downward path of travel of said scalping means for effecting said striking.

2. A grain cleaning apparatus according to claim 1, further comprising:

striker means for removing small debris from the granular material; and vibrating means for facilitating the movement of the granular material along said striker means.

3. A grain cleaning apparatus according to claim 2, wherein said scalping means includes at least one scalper frame, a scalping screen disposed on each of said scalper frames and driving means for causing said vertical reciprocation means to raise and lower each one of said scalping screens to facilitate the movement of the granular material through said housing unit.

4. A grain cleaning apparatus according to claim 3, wherein each said scalper frame and associated scalping screen is inclined downwardly for causing granular material falling on such associated scalping screens to cascade along said scalping screens.

5. A grain cleaning apparatus according to claim 4, wherein each said scalping screen is freely resting on its associated scalper frame.

6. A grain cleaning apparatus according to claim 4, wherein said striker means includes at least one striker frame, and an associated striker screen freely resting thereon for separating purposes;

each striker frame and associated striker screen being inclined downwardly for causing the granular material falling on such associated striker screens to move along said striker screens for separating small debris from the granular material.

7. A grain cleaning apparatus according to claim 6, further comprising:

plate means for receiving the small debris passing through each said striker screen and for guiding said small debris from said housing unit.

8. A grain cleaning apparatus according to claim 7, wherein said striker means is mounted a sufficient spaced-apart distance from said scalping means to form a channel thereinbetween for directing cleaned grain from said housing unit.

9. A grain cleaning apparatus according to claim 8, wherein said housing unit includes a pair of sidewalls, a back wall, and a pair of access doors for permitting a user to obtain access to the interior of said housing unit.

10. A grain cleaning apparatus according to claim 9, wherein each said scalper frame and each said striker frame are mounted between said back wall and said access door to define the outer peripheral path of travel of the granular material as it passes through said housing unit.

11. A grain cleaning apparatus according to claim 9, wherein said plate means includes an upper terminal end and a lower terminal end, said upper terminal end being mounted to the lower terminal end of said striker means and said lower terminal end being mounted in a spaced apart manner from one of said side walls to define an opening for facilitating the discharge of debris.

12. A grain cleaning apparatus according to claim 6, wherein each striker screen is vibrated at a rate ranging between 10 to 100 times per minute.

13. A grain cleaning apparatus according to claim 12, wherein said rate is 40 times per minute.

14. A grain cleaning apparatus according to claim 6, wherein each striker frame includes an integrally connected cross bar member extending across its width.

15. A grain cleaning apparatus according to claim 14, wherein said striker means includes drive shaft means;

said drive shaft means having a drive shaft connected to a driving mechanism for rotating said drive shaft about its longitudinal axis;

said drive shaft means further including at least one actuating assembly for permitting the rotating motion of said drive shaft to be translated into striking energy for vibrating purposes;

base plate means connected to at least one of said striker frames, said base plate means including a hollow boss and being mounted in a substantially parallel spaced-apart manner from said at least one actuating assembly;

channel means mounted to at least one of said striker screens in a substantially parallel spaced apart manner from said cross bar member;

push plate means being movable by said at least one actuating assembly for striking said channel means to impart a vibrating force to said at least one of said striker screens; and a compression spring partially encased within said boss, said compression spring being attached between said boss and said push plate means and acting against said push plate means for forcing it into striking engagement with said channel means.

16. A grain cleaning apparatus according to claim 3, wherein each said scalping screen is tiered in a stair-step manner.

17. A grain cleaning apparatus according to claim 16, wherein each said scalping screen is loosely affixed to its associated scalper frame so it may be raised and lowered to help facilitate the travel of the granular material therealong.

18. A grain cleaning apparatus according to claim 17, wherein each said scalping screen is raised and lowered at rate ranging between 10 to 100 times per minutes.

19. A grain cleaning apparatus according to claim 18, wherein each said scalping screen is raised and lowered at a rate of 20 times per minute.

20. A grain cleaning apparatus according to claim 2, further comprising:

retarding means disposed above said scalping means for slowing the movement of large debris as it moves along said scalping means.

21. A grain cleaning apparatus according to claim 20, wherein said retarding means includes a denim flap extending across substantially the entire width of the scalping means.

22. A grain cleaning apparatus according to claim 2, further comprising:

chute means for directing the separated granular materials including large debris, small debris and cleaned grain along separate paths of travel.

23. A grain cleaning apparatus according to claim 22, wherein said chute means includes an outlet for permitting the separated materials to be discharged from said housing unit.

24. A grain cleaning apparatus according to claim 23, wherein said chute means includes over chute means for directing large debris from said housing unit, fine chute means for directing small debris from said housing unit, and grain chute means for directing the cleaned grain from said housing unit.

25. A grain cleaning apparatus comprising:

housing means for receiving a mixture of material including particles and debris, said housing means having an inlet to permit entrance of the mixture of material into the housing means and an outlet to permit the discharge of the debris from the housing means;

screen means for guiding and directing the mixture of material as it passes from said inlet toward said outlet, said screen means being inclined downwardly from said inlet toward said outlet to permit the mixture of material to fall therealong to separate the debris from the particles by permitting particles to fall through said screen means prior to their falling to said outlet;

vertical reciprocation means for raising at least one intermediate portion of said screen means and for subsequently permitting the raised portion to be lowered from its raised position;

means for impacting abruptly the underside of the screen means to jar loose entrapped particles form openings in said screen means;

means for moving said means for impacting extensively into the downward path of travel of said screen means to permit an abrupt impact between said screen means and said impact means; and coupling means responsive to said vertical reciprocation means for permitting said means for moving to move said impact means rapidly and upwardly into the downward path of travel of said screen means.

26. A method for cleaning granular material comprising the steps of:

receiving a mixture of granular material, said mixture including grain, overs and fines;

guiding said mixture of granular material through a housing unit having an inlet and an outlet as said material falls under the force of gravity between said inlet and said outlet;

directing said falling granular mixture along screen means;

permitting said mixture of granular material selected portions of said screen means to substantially separate the overs, fines and grain from one another;

raising at least one intermediate portion of said screen means and subsequently permitting the raised portion to be lowered from its raised position;

responding to said screen means being lowered;

moving impact means into the downward path of travel of said screen means as it is being lowered; and impacting abruptly the underside of said screen means as it is being lowered to jar loose entrapped granular material from said screen means.

27. A method for cleaning granular material comprising the steps of:

using a scalping means to separate debris from the granular material;

receiving on said scalping screen a flow of granular material having particles and debris therein;

separating said debris from said particles by permitting them to fall through the scalping screen prior to falling to the bottom thereof;

raising and lowering said scalping screen repeatedly to help facilitate the movement of the debris along the scalping screen;

stirring abruptly said scalping screen from below as it moves downwardly for helping to facilitate the removal of the particles that may be lodged in said scalping screen;

responding to said scalping screen moving downwardly only; and moving impact means extensively into the downward path of travel of said scalping screen for effecting said striking.

* * * * *

UNITED STATES PATENT AND TRADEMARK OFFICE

CERTIFICATE OF CORRECTION

PATENT NO. : 5,045,182

DATED : September 3, 1991

INVENTOR(S) : Kenneth W. Butler

It is certified that error appears in the above-identified patent and that said Letters Patent is hereby corrected as shown below:

Column 17, Line 9, after "claim", delete "4" and substitute therefor --5--.

Column 18, Line 23, after "per", delete "minutes" and substitute therefor --minute--.

Column 19, Line 4, after "particles", delete "form" and substitute therefor --from--.

Column 19, Line 24, after "material", insert --to fall through--.

Column 20, Line 20, delete "stirring" and substitute therefor --striking--.

Signed and Sealed this

Twenty-fourth Day of August, 1993

Bruce Lehman

*Attest:*

BRUCE LEHMAN

*Attesting Officer*

*Commissioner of Patents and Trademarks*